US012808073B2

(12) United States Patent
Haegele et al.

(10) Patent No.: US 12,808,073 B2
(45) Date of Patent: Nov. 24, 2026

(54) ELECTROLYZER

(71) Applicant: KANADEVIA INOVA AG, Zürich (CH)

(72) Inventors: Christian Haegele, Stuttgart (DE); Alfred Hering, Stuttgart (DE); Adrian Schneider, Zürich (CH)

(73) Assignee: KANADEVIA INOVA AG, Zürich (CH)

( * ) Notice: Subject to any disclaimer, the term of this patent is extended or adjusted under 35 U.S.C. 154(b) by 570 days.

(21) Appl. No.: 18/286,335

(22) PCT Filed: Apr. 7, 2022

(86) PCT No.: PCT/EP2022/059313

§ 371 (c)(1),
(2) Date: Oct. 10, 2023

(87) PCT Pub. No.: WO2022/214613

PCT Pub. Date: Oct. 13, 2022

(65) Prior Publication Data

US 2024/0191379 A1 Jun. 13, 2024

(30) Foreign Application Priority Data

Apr. 8, 2021 (EP) ..... 21167353

(51) Int. Cl.
*C25B 15/08* (2006.01)
*C25B 1/04* (2021.01)
(Continued)

(52) U.S. Cl.
CPC ..... *C25B 15/08* (2013.01); *C25B 1/04* (2013.01); *C25B 9/65* (2021.01); *C25B 9/75* (2021.01); *C25B 9/77* (2021.01)

(58) Field of Classification Search
CPC ..... C25B 9/73–9/77
(Continued)

(56) References Cited

U.S. PATENT DOCUMENTS 3,926,676 A * 12/1975 Frie ..... C25B 9/73 429/513
4,950,370 A 8/1990 Tarancon
(Continued)

FOREIGN PATENT DOCUMENTS

DE 102014010813 A1 1/2016
EP 0111149 A1 6/1984
(Continued)

OTHER PUBLICATIONS

Machine translation of JP 2020-038773 A obtained online at http://worldwide.espacenet.com (Year: 2020).*
(Continued)

*Primary Examiner* — Harry D Wilkins, III
(74) *Attorney, Agent, or Firm* — LUCAS & MERCANTI, LLP; Klaus P. Stoffel

(57) ABSTRACT

An electrolyzer of the cell-stack type, including a first and a second end plate having a plurality of axially stapled cells in-between the cell stack, a manifold for electrolyte flow from an electrolyte inlet in one of the end plates, the manifold having a plurality of diverting portions diverting primarily axial electrolyte flow into electrolyte flow primarily in the radial plane, and further having a bypass directing electrolyte flow to one of the diverting portions bypassing another one of the diverting portions which is axially closer to the electrolyte inlet than the one diverting portion.

29 Claims, 10 Drawing Sheets

(51) Int. Cl.
*C25B 9/65* (2021.01)
*C25B 9/75* (2021.01)
*C25B 9/77* (2021.01)

(58) Field of Classification Search
USPC ..... 204/255–256
See application file for complete search history.

(56) References Cited

U.S. PATENT DOCUMENTS 5,322,597 A 6/1994 Childs
6,001,226 A * 12/1999 Freire ..... C25B 15/08 204/255
6,878,244 B2 * 4/2005 Sioli ..... C25B 9/77 204/269
11,326,267 B2 * 5/2022 Herrmann ..... H01M 8/04082
2002/0175072 A1 * 11/2002 Sioli ..... C25B 9/77 204/267
2004/0040838 A1 3/2004 Helmke
2020/0040474 A1 * 2/2020 Herrmann ..... C25B 9/73
2021/0156039 A1 * 5/2021 Ballantine ..... C25B 15/02

FOREIGN PATENT DOCUMENTS

EP 0212240 B1 12/1991
JP 2020038773 A * 3/2020 ..... C25B 1/042

OTHER PUBLICATIONS

International Search Report Dated Aug. 1, 2022 in Application PCT/EP2022/059313, 2 Pages.

* cited by examiner

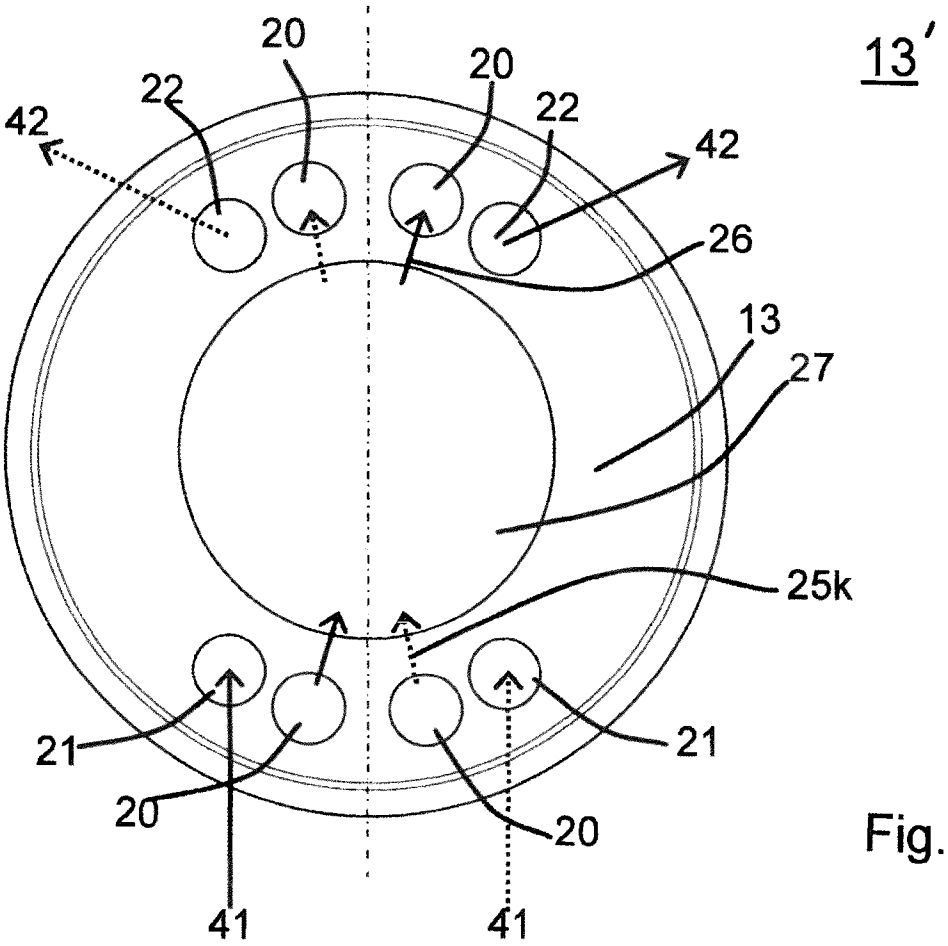
Fig.5a
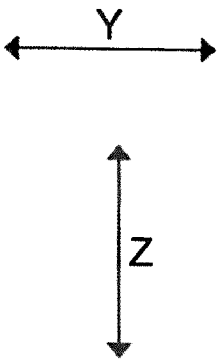

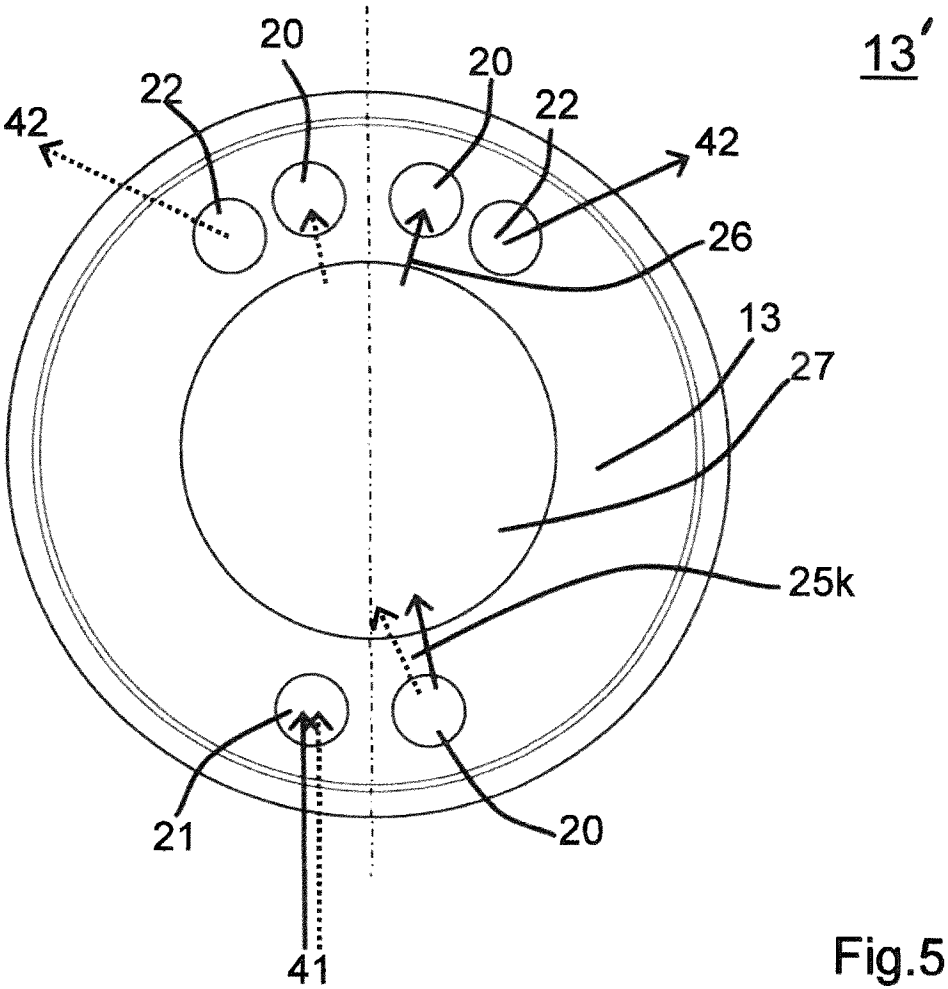
Fig.5 b
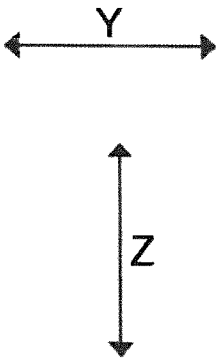

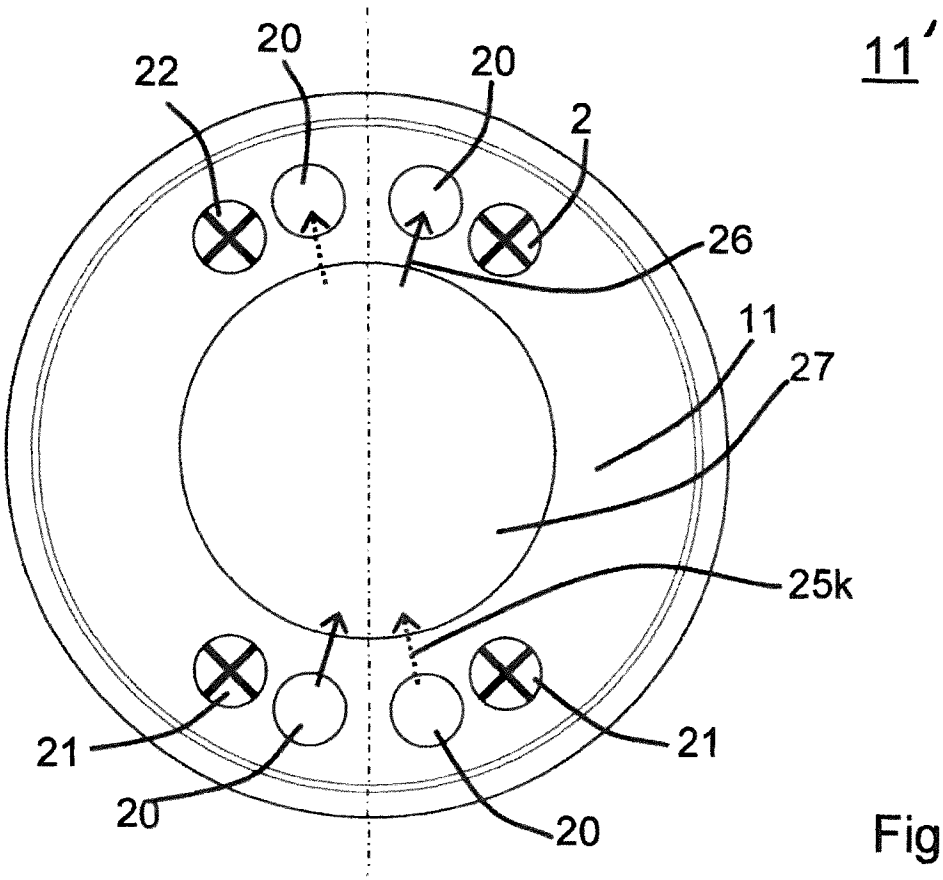
Fig.6a
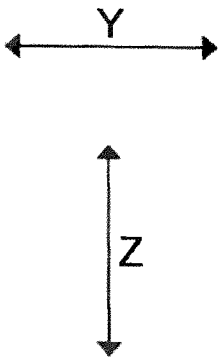

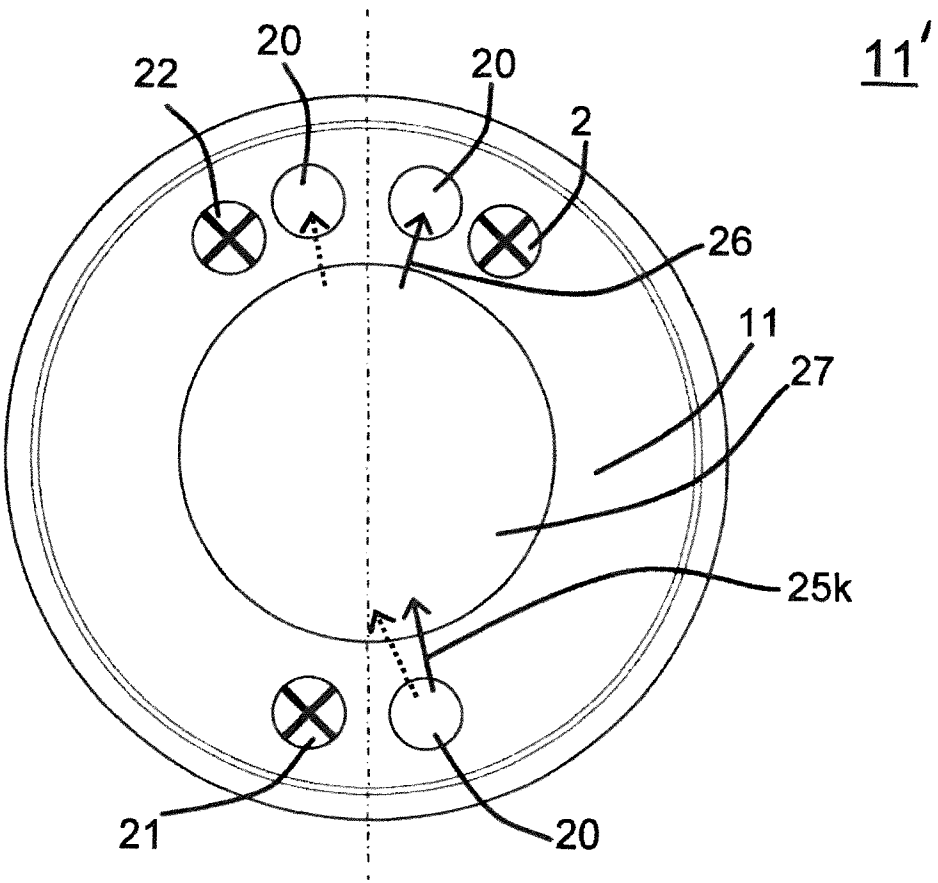
Fig.6b
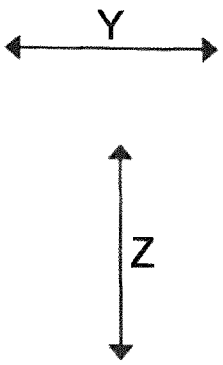

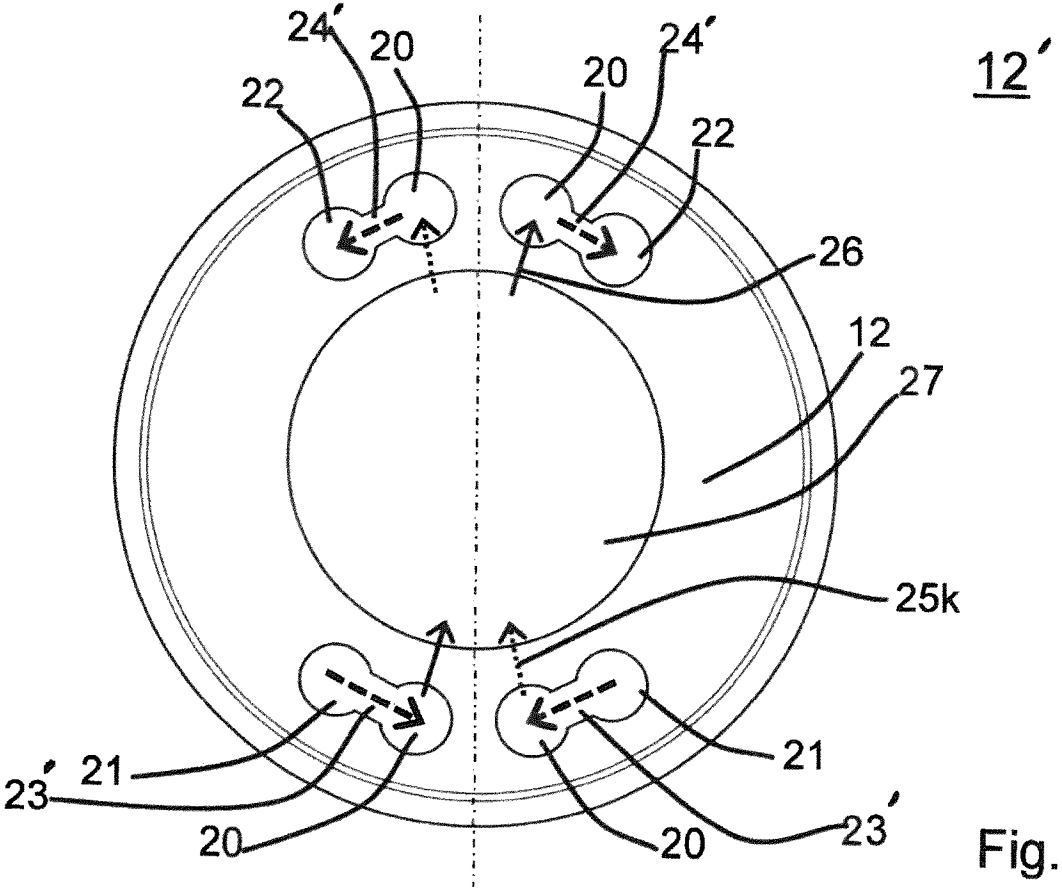
Fig.7a
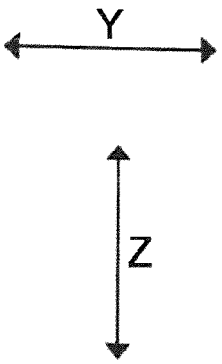

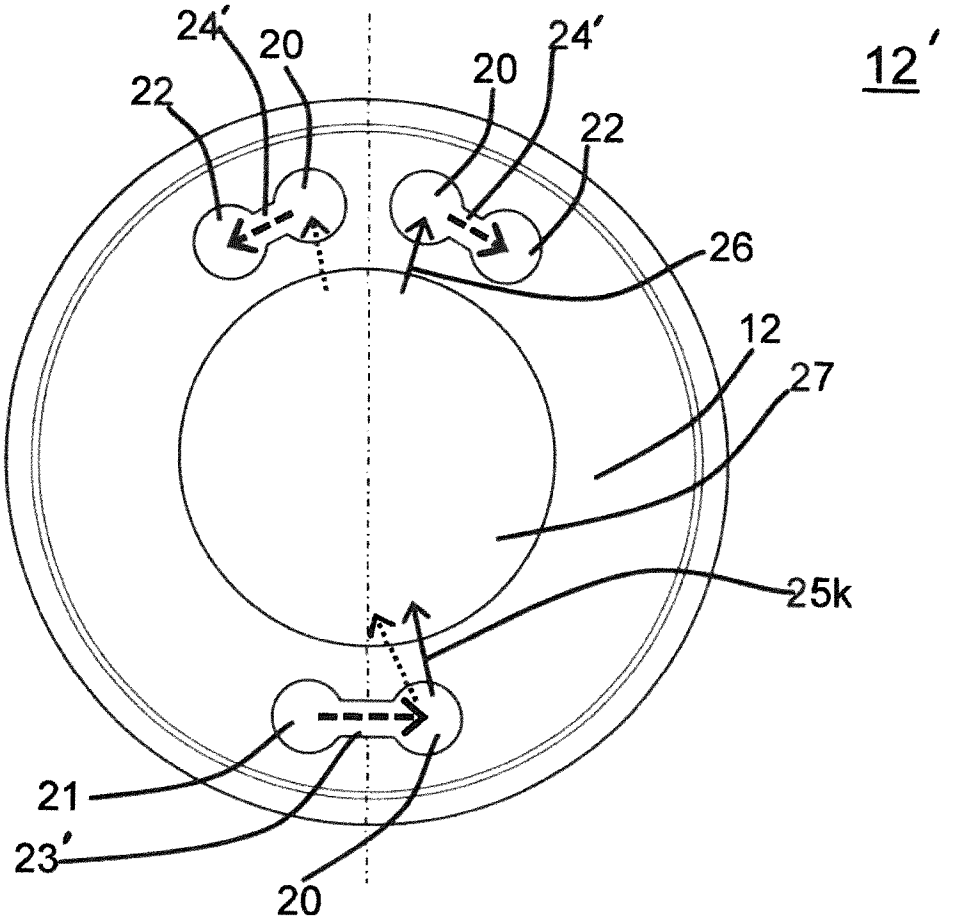
Fig.7b
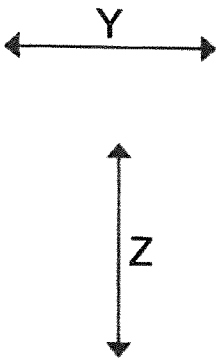

ELECTROLYZER

CROSS-REFERENCE TO RELATED APPLICATIONS

The present application is a 371 of International application PCT/EP2022/059313, filed Apr. 7, 2022, which claims priority of EP 21167353.8 filed Apr. 8, 2021, the priority of these applications is hereby claimed and the applications are incorporated herein by reference.

BACKGROUND OF THE INVENTION

The invention relates to the field of electrolyzers and in particular to electrolyzers of the cell-stack type comprising a first and a second end plate having a cell stack with a plurality of axially stapled cells in-between, a manifold for electrolyte flow from an electrolyte inlet in one of the end plates, said manifold comprising a plurality of diverting portions diverting primarily axial electrolyte flow into electrolyte flow primarily in the radial plane. Such electrolzyers of the cell-stack type are well-known in the art and are disclosed, for instance, in EP 0 212 240 B1 or DE 10 2014 010 813 A1.

During operation of such electrolyzers, the electrolyte, for instance $KOH_{aq}$, flows through the manifold or manifolds created by holes and openings in the cell frames when those cell frames are stapled to form the cell stack, thereby passing the active areas in the interior of the cells.

However, it turned out that such conventional electrolyzers sometimes suffer in performance due to arising unwanted electric currents.

SUMMARY OF THE INVENTION

Therefore, the object underlying the invention is to provide an electrolyzer having a good combination of a reasonably stable operation condition and still sufficiently simple structure and flexibility of use.

To this end, the invention provides an electrolyzer as initially introduced which is essentially characterized by a bypass directing electrolyte flow to one of the diverting portions bypassing another one of said diverting portions which is axially closer to the electrolyte inlet than said one diverting portion.

By such a configuration, a pressure loss inhomogeneity in the electrolyte supply over the cells identified to be responsible for the risk of inefficient cooling of the process in particular close to the side opposite to the side where the electrolyte inlet and outlets are provided and thereby to be at least partly responsible for effects detrimental to the performance efficiency of conventional electrolyzers. By said bypass, the pressure drop characteristic over the cells becomes more equilibrated or homogeneous, and a better performance at a fixed number of cells can be obtained, or an increase in the number of cells becomes possible without deterioration with respect to conventional electrolyzers with fewer cells. Further, regarding the electric coupling, there is still the possibility to connect two electrolyzers in series with one rectifier in an arrangement/plant having more than two electrolyzers. Due to the bypass, the flow has no (radial) communication to the bypassed diverting portion but is forced to skip said diverting portion at the respective axial position.

As is explained later in the detailed description of the figures, for sake of simplified explanations, subdividing the cells in half-cells is omitted. Said later description applies, therefore, respectively separately for electrolyte flow through anode-side half-cells on the one hand side and cathode-side half-cells on the other hand side. That is, when the cell structure itself is that with bipolar plates and electrodes and membrane or diaphragm, and when there are separated channels one for each two groups of half-cells on the inlet side, the invention provides an electrolyzer of the cell-stack type, comprising a first and a second end plate having a cell stack with a plurality of axially stapled cells in-between, the cells having a cell structure with bipolar plate, membrane/diaphragm and having an active area inside, the cells being further subdivided in half-cells to have an anode-side half-cell and a cathode-side half-cell, a manifold for electrolyte flow from an electrolyte inlet in one of the end plates, said manifold comprising a plurality of diverting portions diverting primarily axial electrolyte flow into electrolyte flow primarily in the radial plane and guiding the electrolyte flow into the active area of one of an anode-side half-cell and a cathode-side half-cell, characterized by a bypass directing on the one hand side electrolyte flow to one of the diverting portions for an anode-side half-cell of a cell bypassing another one of said diverting portions for an anode-side half-cell of another cell which is axially closer to the electrolyte inlet than said one diverting portion, and directing on the other hand side, electrolyte flow to one of the diverting portions for a cathode-side half-cell of a cell bypassing another one of said diverting portions for a cathode-side half-cell of another cell which is axially closer to the electrolyte inlet than said one diverting portion.

For these configurations, the plurality of diverting portions comprises a plurality of first or anode-side diverting portions and a plurality of second or cathode-side diverting portions. Then, for the anode-side insert flow, said flow has no (radial) communication to the respective bypassed anode-side diverting portion, but is forced to skip said diverting portion at the respective axial position, and vice versa for the cathode-side.

In case that one uses a common channel for all kind of half-cells, one understands the diverting portions as attributed each to one cell, as shown in FIG. 1 in the later figurative description, said cell-attributed diverting portion comprising, of course, each a anode-side branch and a cathode-side branch, and the bypass is such that both anode-side branch and cathode-side branch of one cell-attributed diverting portion is skipped by the flow in the common channel. This is in particular contrary to an arrangement known for instance from U.S. Pat. No. 4,950,370 A, where, from the flow within one axial channel, there is one deviation after the other into radial direction, and only cells are skipped that are provided with flow from another channel, as can be seen from said document.

Namely, the bypass of the subject invention is attributed to a flow flowing through the same axial channel, that is the bypassed diverting portion and the diverting portion where the flow skipping the bypass diverting portion is directed, depart from the same axial channel. This does not mean that the invention excludes solutions where part of the cells are supplied via one axial channel, and other cells are supplied via another axial channel. However, the bypass and skipping according to the invention is to be understood with reference to one and the same channel.

Accordingly, the invention provides an electrolyzer of the cell-stack type, comprising a first and a second end plate having a cell stack with a plurality of axially stapled cells in-between, a manifold for electrolyte flow from an electrolyte inlet in one of the end plates, said manifold comprising a plurality of diverting portions diverting electrolyte flow flowing in an primarily axial channel of said manifold into electrolyte flow primarily in the radial plane, characterized by a bypass directing electrolyte flow to one of the diverting portions directly connected to said primarily axial channel via bypassing another one of said diverting portions which is directly connected to said primarily axial channel and which is axially closer to the electrolyte inlet than said one diverting portion. The term "primarily axial" is to be understood in the usual way that the direction component of the extension direction of the channel in axial direction is the major direction component, that is said axial direction component is larger than the direction component in the radial plane.

This reference/attribution of the one diverting portion and the other one (bypassed/skipped) diverting portion to the same channel holds also in the case of separate channels one for each group of anode-side and cathode-side half-cells.

In a preferred embodiment, all diverting portions are directly connected to one channel, preferably axial channel having the same radial and azimuthal position (when this is the channel for all kind of half-cells), respectively all anode-side attributed diverting portions are directly connected to one and the same such axial channel for anode-side electrolyte flow delivery, while all cathode-side attributed diverting portions are directly connected to such channel for electrolyte flow delivery to the cathode-side half-cells.

In a preferred embodiment, the length of a flow path from the electrolyte inlet to said another diverting portion is longer than the length of a fluid path from the electrolyte inlet to said one diverting portion. One can still use a simple channel/passage construction, even without unidirectional flow.

In a further preferred embodiment, more than a first plurality of diverting portions is by-passed, preferably more than 20% thereof, in particular more than 33% thereof. This even more increases pressure loss axially far from the cathode side end plate. On the other hand side, it is preferred that a third plurality of diverting portions is not by-passed, preferably more than 20% thereof, in particular more than 25% thereof. Thereby, the pressure loss problem is shifted to the other end only in a limited amount, where, however, the cooling problem is less severe due to the temperature gradient established in the electrolyte flow during operation. The invention is (thus) in particular related to a partial bypass, that is, there is no flow where direct flow access to all cells is in the order of the ranking of the arrangement of the cells in flow direction of one and the same flow.

In a further preferred embodiment, upstream flow to a second plurality of diverting portions is via the bypass, preferably to more than 20%, in particular to more than 33% thereof. The second plurality can coincide with the third plurality. In a rather simple construction, the second plurality is preferably lower than 67% of the overall cells, in particular lower than 60% thereof.

In a further preferred embodiment, the manifold comprises one or more branching portion(s) directing electrolyte flow axially in both directions. This allows use of a passage for electrolyte flows of different axial flow direction.

In a further preferred embodiment, a branching portion has an essentially radial and/or azimuthal electrolyte flow before the branching-off, that is, with respect to the projection plane orthogonal to the axial direction of the cell stack, the bypass is shifted with respect to in particular a channel extending axially through the cells and where the diverting portions are arranged, in radial and/or circumferential (azimuthal) direction. In a preferred embodiment, an axial bypassing channel and a channel adjacent to the diverting portions are azimuthally displaced with respect to each other. This allows a more compact frame construction.

In a further preferred embodiment, the length of the flow path from the electrolyte inlet to the diverting portion axially most distant from the electrolyte inlet is shorter than the length of the flow path from the electrolyte inlet to the diverting portion axially closest to the electrolyte inlet. This even more improves the pressure drop situation to some extent, although creating an asymmetric flow path length distribution.

In a further preferred embodiment, it is provided that the electrolyzer has an axial channel extending through the cell frames of more than 20%, in particular more than 33%, more preferably more than 50%, in particular of all cells of the cell frame. Said channel connects the diverting portions. It is also envisaged to have more of such channels each of which connecting a part of the diverting portions.

In a further preferred embodiment, an axial position of at least one branching portion is closer to the other end plate than to the end plate that has the electrolyte inlet, in particular by at least 4%, preferably at least 8%, in particular at least 12%. This provides for a reasonable distribution of flow path lengths.

In a further preferred embodiment, a difference between axial flow parts of the overall flow path length up to an outlet of on the one hand side a flow path running through the cell axially most distant from the electrolyte inlet and on the other side that running through the cell axially closest to the inlet divided by the sum thereof is lower than 20%, preferably lower than 12%, in particular lower than 8%. This allows more homogeneous flow path lengths in particular regarding the longest flow path length from inlet through the cells to the outlet.

In another embodiment, one can provide that a difference between axial flow parts of the overall flow path length up to an outlet of on the one hand side a flow path running through the cell axially most distant from the electrolyte inlet and on the other side that running through the cell axially closest to the inlet divided by the sum thereof is larger than 4%, preferably larger than 8%, in particular larger than 12%. In particular, one can provide to have a branching portion and a collection portion (corresponding to an inverse branching portion of the outlet side) within one cell frame only.

In a further preferred embodiment, the electrolyzer comprises at least 30, preferably at least 50, in particular at least 80 cells. It is even envisaged to have at least 100 cells, even at least 120 cells, even at least 140 cells.

The cell structure itself may be that with bipolar plates and electrodes and membrane or diaphragm, preferably within one single frame per cell. In this regard, the structure as explained in FIG. 1A of DE 10 2014 010 813 A1 is incorporated by reference, independently of the presence of an additional reinforcement ring.

Further, the invention provides an arrangement or plant comprising at least one rectifier having its poles connected to the end plates of an electrolyzer, wherein two electrolyzers are connected in series to one of said at least one rectifier, and one or both of said two electrolyzers are configured according to any of the preceding aspects.

Further, the invention provides also a method of performing electrolysis, in particular electrolysis of water, by using one or more electrolyzers configured according to any of the preceding aspects.

BRIEF DESCRIPTION OF THE DRAWING

Further features, details and advantages of the invention result from the following description with reference to the accompanying drawings, in which FIG. 1 schematically shows an electrolyzer with an electrolyte manifold, FIG. 2 schematically shows an electrolyzer with another electrolyte manifold, FIG. 3 schematically shows an electrolyzer with still another electrolyte manifold, FIG. 4 schematically shows an electrolyzer with a still further electrolyte manifold, FIGS. 5*a*, 5*b* show cross-sections of embodiments of cell frames in a bypassing zone, FIGS. 6*a*, 6*b* show cross-sections meant for a position beyond a bypassing zone, and FIGS. 7*a*, 7*b* show cross-sections of cell frames including a connection passage.

DETAILED DESCRIPTION OF THE INVENTION

Figure 1:
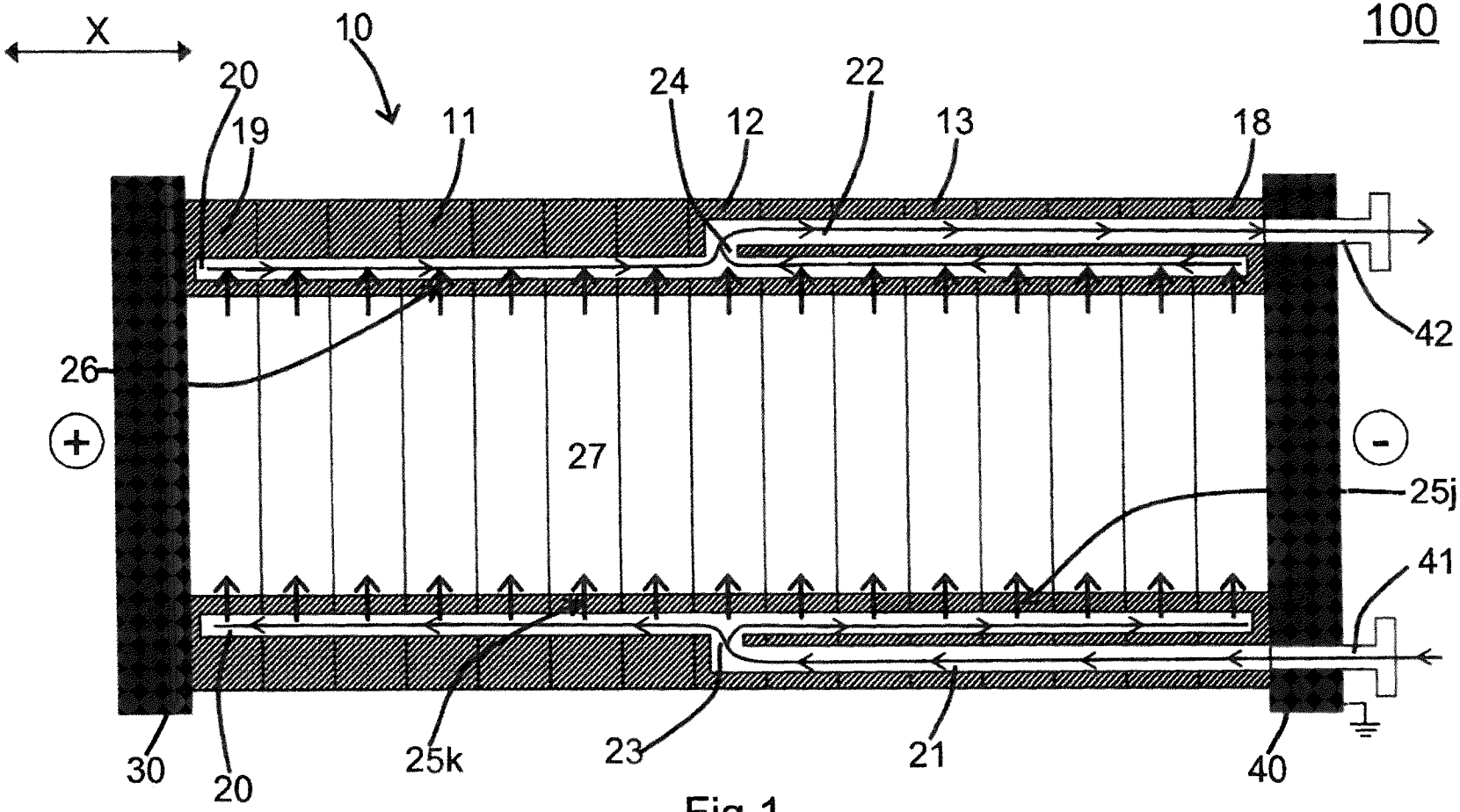

As can be seen from FIG. 1, electrolyzer 100 comprises a stack 10 of cells stapled in an axial direction X between end plates 30 (anode side) and 40 (cathode side, grounded). In the shown embodiment, although not recognizable from the axial sectional view, the cells with their cell frames are of circular form when seen in projection orthogonal to the axial direction X (FIGS. 5 to 7). For sake of simplified explanations, subdividing the cells in half-cells is omitted. For concrete realizations with cells configured with bipolar plates, it is to be understood that the subsequent description applies respectively separately for electrolyte flow through anode-side half cells on the one hand side and cathode side half cells on the other hand side.

The cell frames have axially extending through-holes forming, in the stacked arrangement, an axially extending channel or passage 20 on the inlet side and another axially extending channel or passage 20 on the outlet side. Electrolyte is flowing through the channel 20 on the inlet side in an essentially axial flow direction. At diverting portions 25, the electrolyte flow is guided into the active area 27 inside the cells, where the electrolyte flow is essentially in the radial plane orthogonal to the axial direction X. At the outlet side, (inverse) diverting portions 26 guide the electrolyte flow in the radial plane again into an essentially axial electrolyte flow.

Such an arrangement of the cell staple 10 of the above partial description of FIG. 1 is well-known, and conventionally the inlet 41 and outlet 42 in the end plate 40 are flush with the channels 20, such that the ranking of the cells in their axial distance from cathode side end plate 40 with inlet 41 and outlet 42 corresponds to their ranking of the associated diverting portion regarding their action onto the electrolyte flow path in channel 20 from the inlet 41.

In the embodiment of FIG. 1, the position of the inlet 41 in the radial plane is displaced with respect to a position flush with the axial channel 20. Further, the cell frames of the cells close to the cathode side end plate 40 are provided with additional through-holes forming, in the stapled configuration, a second channel or passage 21 extending axially and parallel to channel 20 through a plurality of cells, in the embodiment of FIG. 1 to roughly half of the cells of the cell staple 10. At a cell 12 roughly at the axial center of the cell staple 10, there is a linking passage 23 linking the second axial channel 21 with the (first) axial channel 20. Thereby, the electrolyte flow, notwithstanding being guided through inlet 41 in cathode side end plate 40, enters the axial passage 20 rather at the axial center of cell staple 10. From here, the electrolyte flow is directed on the one-hand side in axial flow direction vs. the anode-side end plate 30, and on the other hand, with respect to said "forward" flow, in a "backflow" in axial direction towards the cathode side end plate 40. The further flow of the electrolyte is then again through the diverting portions 25 through the active areas 27 of the cells, to be then collected in axial channel 20 on the outlet side in this exemplary embodiment. Final outflow of the electrolyte is, in the shown embodiment, again in a second axial passage 22 displaced in the radial plane with respect to (first) passage 20 and being flush with the outlet 42 in the cathode side end plate 40. In the shown embodiment in FIG. 1, fluid connection between passages 20 and 22 on the outlet side is done via portion 24 essentially diametrically opposite to connection passage 23 in the cell frame of cell 12. However, said link could be arranged also in another axial location.

In the shown embodiment, there is only one linking passage 23, 24 at each inlet and outlet sides. However, in other, not-figuratively shown embodiments there could be more of them. In such cases, the linking portions could be throttled differently with respect to each other so as to arrange for a correlated flow along all flow paths through the different cells as regards the volume flow.

In the embodiment of FIG. 1, the displacement of the second axial passages 21, 22 with respect to the axial passages 20 is shown as a radial displacement. This is a possible solution, which is selected for graphical representation also for sake of explanation. It could, however, and even more preferred, be also arranged as displacement in circumferential direction (azimuthal displacement), or a displacement containing radial as well as azimuthal components.

Figure 2:
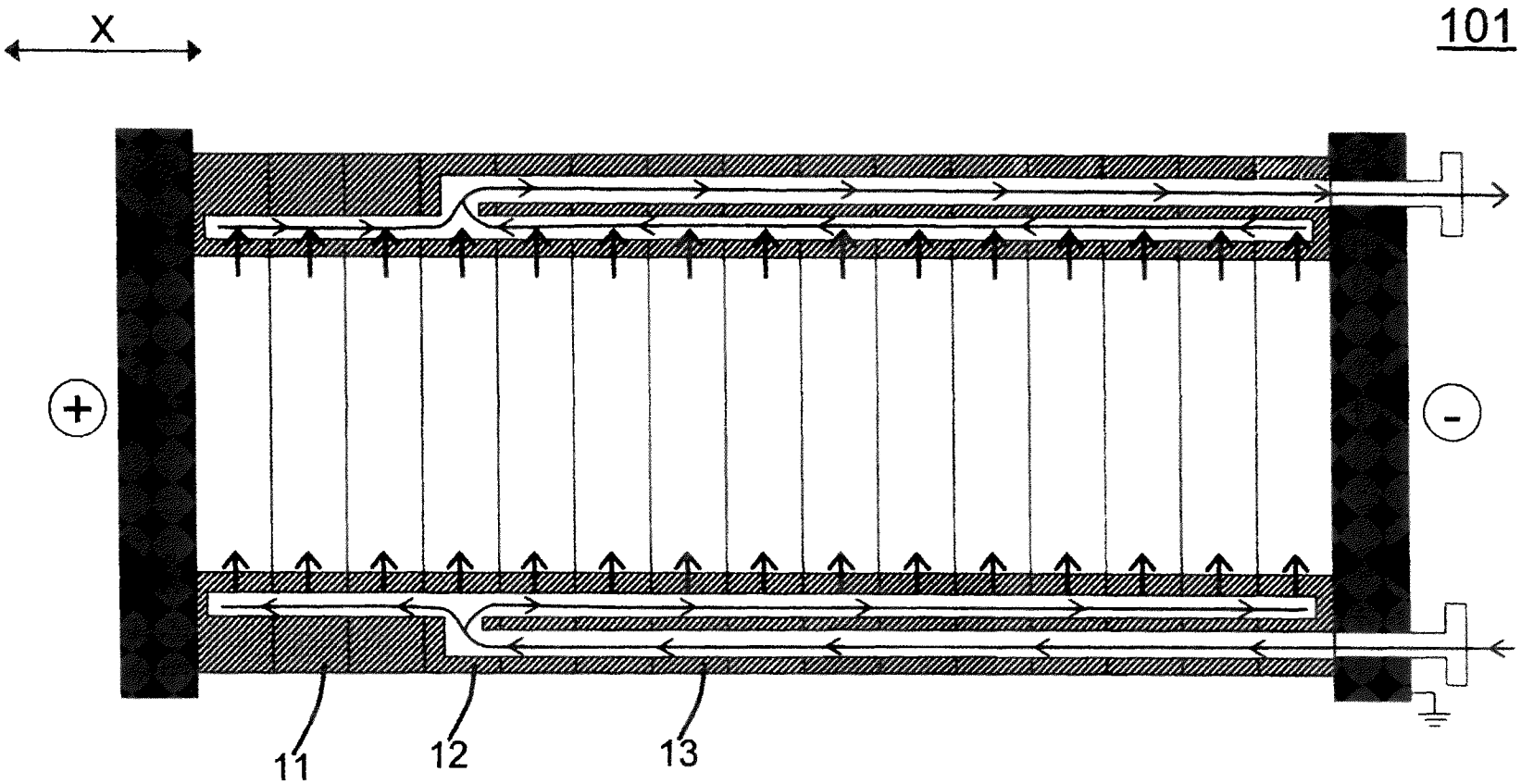

In the embodiment of FIG. 1, a linking between channels 21, 22 and 20 is about at the axial center of the staple 10. However, in other embodiments as that shown in FIG. 2 with electrolyzer 101, there can be an asymmetric arrangement, and said linking is shifted versus the anode side, respectively away from the cathode side.

Figure 3:
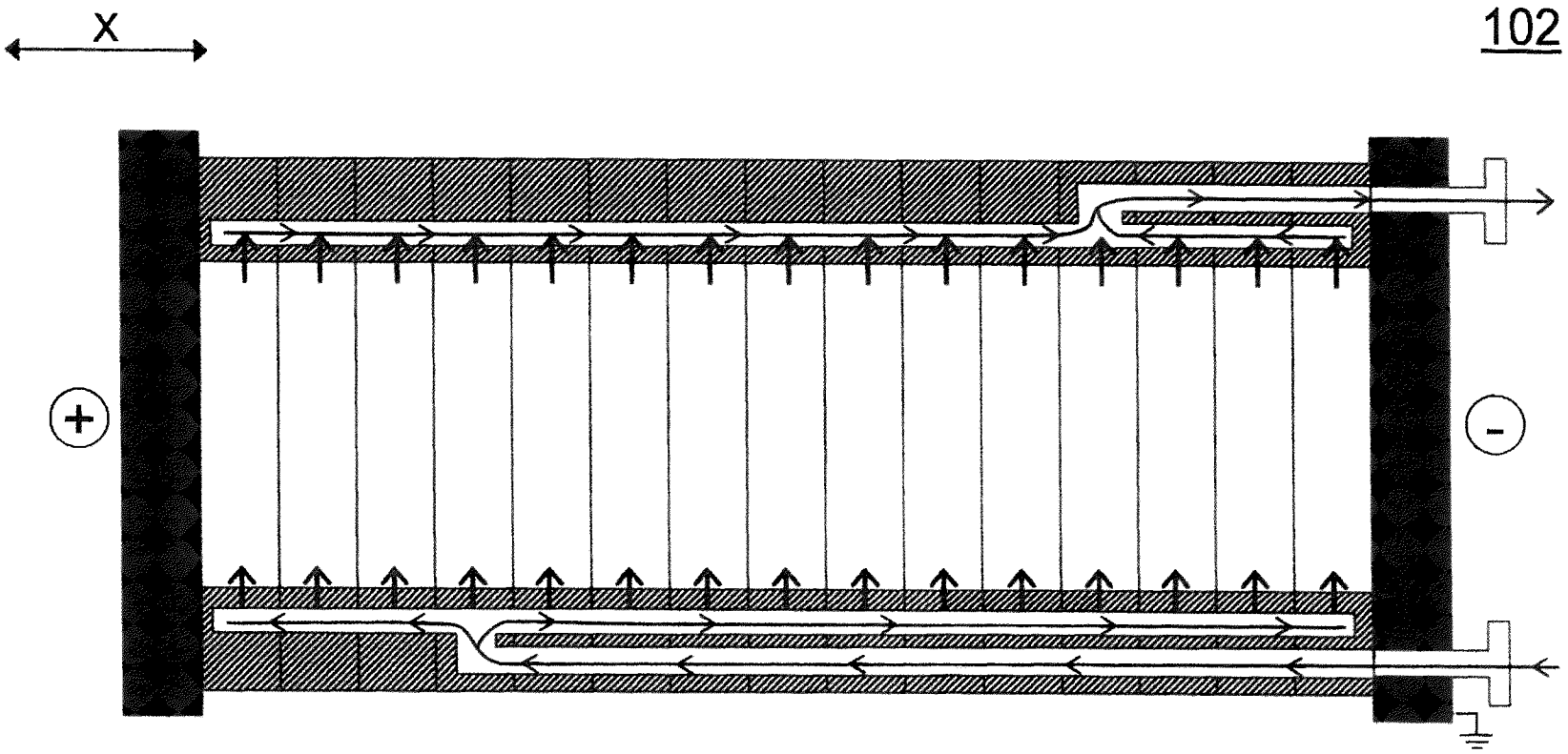

In the embodiment shown in FIG. 3 with electrolyzer 102, there is a "double-asymmetric arrangement", in which the linking 23 on the cathode side is shifted vs. the anode side, while the linking 24 at the outlet side is shifted vs. the cathode side (with the axial center of the staple 10 as reference for said shift). In the embodiment of FIG. 3, the flow path lengths for the cell axially closest to the cathode side end plate 40 and the cell axially closest to the anode side end plate 30 are essentially equal.

Figure 4:
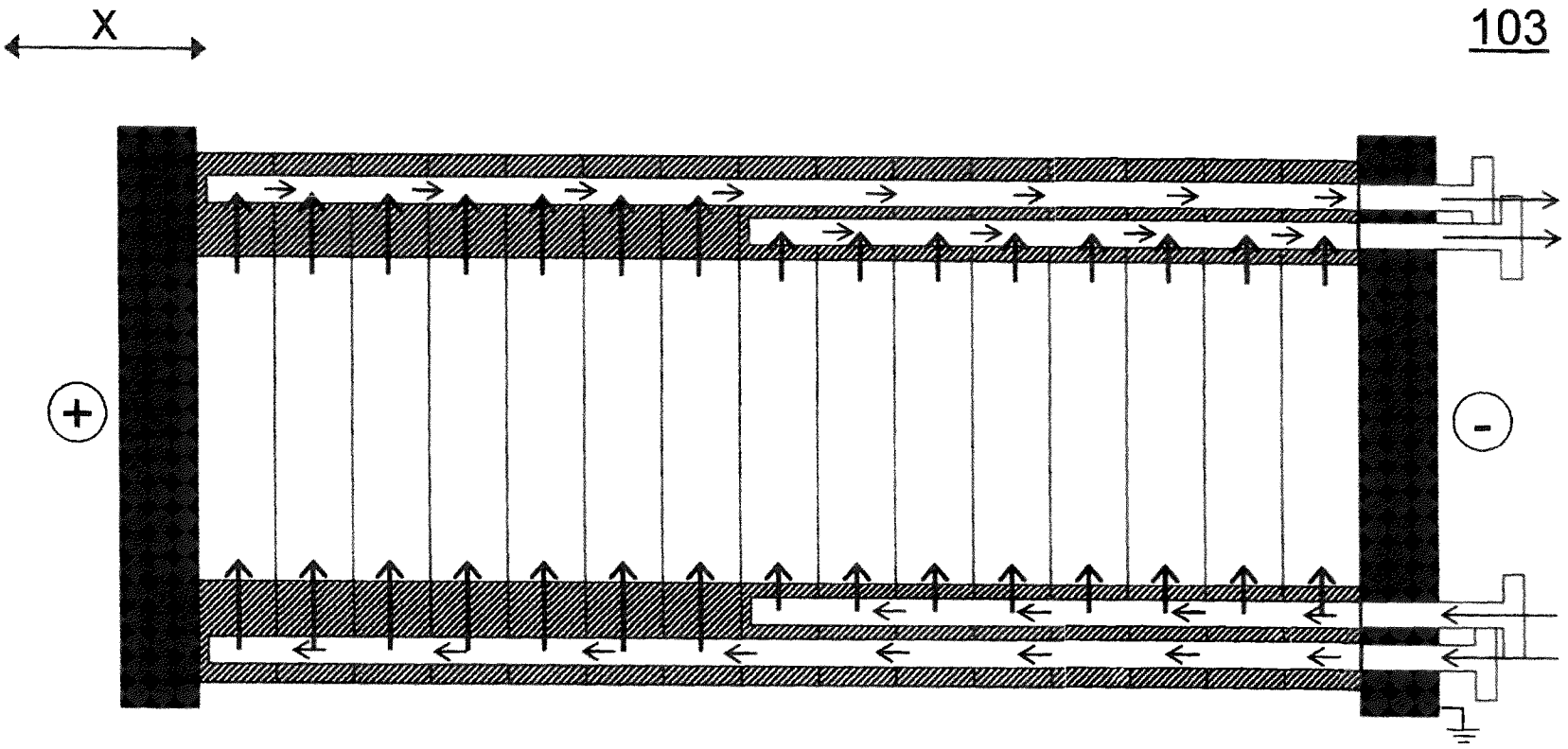

For the embodiment of FIG. 4 with electrolyzer 103, the bypass is implemented in a way that a flow splitting is already made outside the end plate. A portion of the cells close to the entry side is supplied via a first supply channel, while other cells are supplied bypassing the supply of said portion. Also for the embodiment of FIG. 4, a modification in which the channels (shown as radially displaced) are azimuthally displaced, is possible and even preferred.

FIG. 5*a* shows a cross-section of a cell frame 13' corresponding to cell frame 13 of FIG. 1 but in the modified embodiment where channel 21 is not radially displaced from channel 20 but azimuthally displaced, as well as for channels 22, 20 for the backflow. Reference numerals 41, 42 in FIG. 5*a* indicate the communication to respective fluid inlet 41 and fluid outlet 42 of FIG. 1. Moreover, as one recognizes for the embodiment of FIG. 5*a*, there is a channel 20 and a channel 21 for each two group of half-cells on the inlet side, that is a symmetrical arrangement with respect to the outlet side where separation is required. However, there is also the possibility to use only one channel 20 and 21 as a common channel for all kind of half cells. This is shown in FIG. 5*b*.

FIGS. 6*a* and 6*b* correspond to said different embodiments of FIG. 5*a* and FIG. 5*b*, however, for a cell frame 11' which is situated at the position of cell frame 11 of FIG. 1. The black crosses in channels 21, 22 demonstrate that there is no fluid passing through the channels. This is because channels 21, 22 (see FIG. 1) are not continued up to the other end plates, but merge at connection passage 23 into channel 20. As can be easily recognized from FIGS. 6*a*, respectively 6*b*, the through-holes for channels 21, 22 are not needed and may not be present—however, the through-holes can also be present (even when they are not used), such that cell frames 11' and 13' can be manufactured in an identical manner.

Then, the only cell frame which is (needs) to be manufactured differently is that (those) containing connection passage 23 (23') between channel 20 and 21 on the inlet side, respectively 22 and 20 on the channel outlet side. Cross-sections of these cell frames 12' are shown in FIG. 7*a* (symmetric arrangement) and FIG. 7*b* (one channel 20 on the inlet side only), wherein again reference numeral 12' indicates that in FIGS. 7*a*, 7*b* an embodiment with azimuthal displacement between channels 22 and bypassing channels 21, 22 is shown, whereas, in the figurative representation for cell 12 of FIG. 1, there is radial displacement (mainly for illustration purpose, but also as a valid embodiment).

As one can take from the above, details of the linking can be varied as guided by the above features. By presence of the bypass 21, a more favorable more homogeneous pressure drop situation for the electrolyte flow is achieved, leading to an improved performance of the electrolyzer.

The invention is not limited to the details as shown in the figurative description. Rather, features of the above description and features of the subsequent claims can be essential to the invention alone or in combination.

The invention claimed is:

1. An electrolyzer of a cell-stack type, comprising:

a first end plate;

a second end plate;

a cell stack with a plurality of axially stapled cells arranged in-between the first end plate and the second end plate;

a manifold for electrolyte flow from an electrolyte inlet in one of the end plates, said manifold comprising a plurality of diverting portions arranged to divert primarily axial electrolyte flow into electrolyte flow primarily in a radial plane; and a bypass arranged to direct electrolyte flow to one of the diverting portions and bypass another one of the diverting portions that is axially closer to the electrolyte inlet than said one diverting portion, wherein the manifold comprises at least one branching portion arranged to direct electrolyte flow axially in both directions.

2. The electrolyzer according to claim 1, wherein a length of a flow path from the electrolyte inlet to said another diverting portion is longer than a length of a fluid path from the electrolyte inlet to said one diverting portion.

3. The electrolyzer according to claim 1, wherein more than a first plurality of diverting portions is by-passed.

4. The electrolyzer according to claim 3, wherein more than 20% of the first plurality of diverting portions is bypassed.

5. The electrolyzer according to claim 4, wherein more than 33% of the first plurality of diverting portions is bypassed.

6. The electrolyzer according to claim 1, wherein an upstream flow to a second plurality of diverting portions is via the bypass.

7. The electrolyzer according to claim 6, wherein more than 20% of the upstream flow to the second plurality of diverting portions is via the bypass.

8. The electrolyzer according to claim 7, wherein more than 33% of the upstream flow to the second plurality of diverting portions is via the bypass.

9. The electrolyzer according to claim 1, wherein the at least one branching portion includes a branching portion having an essentially radial and/or azimuthal electrolyte flow before branching-off.

10. The electrolyzer according to claim 1, wherein a length of a flow path from the electrolyte inlet to a diverting portion axially most distant from the electrolyte inlet is shorter than a length of a flow path from the electrolyte inlet to a diverting portion axially closest to the electrolyte inlet.

11. The electrolyzer according to claim 1, further comprising an axial channel that extends through cell frames of more than 20% of the cells of the cell frame.

12. The electrolyzer according to claim 11, wherein the axial channel extends through cell frames of more than 33% of the cells of the cell frame.

13. The electrolyzer according to claim 12, wherein the axial channel extends through cell frames of more than 50% of the cells of the cell frame.

14. The electrolyzer according to claim 13, wherein the axial channel extends through cell frames of all of the cells of the cell frame.

15. The electrolyzer according to claim 1, wherein an axial position of the at least one branching portion is closer to the end plate without the electrolyte inlet than to the end plate that has the electrolyte inlet.

16. The electrolyzer according to claim 15, wherein the axial position of the at least one branching portion is at least 4% closer to the end plate without the electrolyte inlet than to the end plate that has the electrolyte inlet.

17. The electrolyzer according to claim 16, wherein the axial position of the at least one branching portion is at least 8% closer to the end plate without the electrolyte inlet than to the end plate that has the electrolyte inlet.

18. The electrolyzer according to claim 17, wherein the axial position of the at least one branching portion is at least 12% closer to the end plate without the electrolyte inlet than to the end plate that has the electrolyte inlet.

19. The electrolyzer according to claim 1, wherein a difference between axial flow parts of an overall flow path length up to an outlet of a flow path running through a cell axially most distant from the electrolyte inlet and a flow path running through a cell axially closest to the inlet divided by a sum thereof is lower than 20%.

20. The electrolyzer according to claim 19, wherein the difference between axial flow parts of the overall flow path length up to the outlet of the flow path running through the cell axially most distant from the electrolyte inlet and the flow path running through the cell axially closest to the inlet divided by the sum thereof is lower than 12%.

21. The electrolyzer according to claim 19, wherein the difference between axial flow parts of the overall flow path length up to the outlet of the flow path running through the cell axially most distant from the electrolyte inlet and the flow path running through the cell axially closest to the inlet divided by the sum thereof is lower than 8%.

22. The electrolyzer according to claim 1, wherein a difference between axial flow parts of an overall flow path length up to an outlet of a flow path running through a cell axially most distant from the electrolyte inlet and a flow path running through a cell axially closest to the inlet divided by a sum thereof is larger than 4%.

23. The electrolyzer according to claim 22, wherein the difference between axial flow parts of the overall flow path length up to the outlet of the flow path running through the cell axially most distant from the electrolyte inlet and the flow path running through the cell axially closest to the inlet divided by the sum thereof is larger than 8%.

24. The electrolyzer according to claim 23, wherein the difference between axial flow parts of the overall flow path length up to the outlet of the flow path running through the cell axially most distant from the electrolyte inlet and the flow path running through the cell axially closest to the inlet divided by the sum thereof is larger than 12%.

25. The electrolyzer according to claim 1, comprising at least 30 cells.

26. The electrolyzer according to claim 25, comprising at least 50 cells.

27. The electrolyzer according to claim 26, comprising at least 80 cells.

28. An arrangement, comprising: at least one rectifier having poles connected to end plates of an electrolyzer; and two electrolyzers connected in series to one of said at least one rectifier, wherein at least one of said two electrolyzers is configured according to claim 1.

29. A method of performing electrolysis, comprising the steps of: diverting, in a diverting area, a primarily axial electrolyte flow into an electrolyte flow primarily in a radial plane; and, bypassing at least part of the primarily axial electrolyte flow around the diverting area to at least another cell of the electrolyzer so that electrolyte flow is directed to a diverting area downstream of the bypassed diverting area, the method including using at least one electrolyzer of a cell-stack type, comprising: a first end plate; a second end plate; a cell stack with a plurality of axially stapled cells arranged in-between the first end plate and the second end plate; a manifold for electrolyte flow from an electrolyte inlet in one of the end plates, said manifold comprising a plurality of diverting portions arranged to divert primarily axial electrolyte flow into electrolyte flow primarily in a radial plane; and a bypass arranged to direct electrolyte flow to one of the diverting portions and bypass another one of the diverting portions that is axially closer to the electrolyte inlet than said one diverting portion, wherein the manifold comprises at least one branching portion arranged to direct electrolyte flow axially in both directions.

* * * * *